US010767858B2

(12) United States Patent
Heitmann et al.

(10) Patent No.: US 10,767,858 B2
(45) Date of Patent: Sep. 8, 2020

(54) COOLING DEVICE FOR A BURNER OF A GASIFICATION REACTOR

(71) Applicant: Air Products and Chemicals, Inc., Allentown, PA (US)

(72) Inventors: Alfons Heitmann, Gummersbach (DE); Roland Reimesch, Amsterdam (NL); Thomas Paul Von Kossak-Glowczewski, Amsterdam (NL)

(73) Assignee: Air Products and Chemicals, Inc., Allentown, PA (US)

( * ) Notice: Subject to any disclaimer, the term of this patent is extended or adjusted under 35 U.S.C. 154(b) by 197 days.

(21) Appl. No.: 15/766,595

(22) PCT Filed: Oct. 10, 2016

(86) PCT No.: PCT/EP2016/074152
§ 371 (c)(1),
(2) Date: Apr. 6, 2018

(87) PCT Pub. No.: WO2017/063981
PCT Pub. Date: Apr. 20, 2017

(65) Prior Publication Data

US 2018/0292088 A1 Oct. 11, 2018

(30) Foreign Application Priority Data

Oct. 12, 2015 (EP) ..... 15189436

(51) Int. Cl.
*F23D 14/78* (2006.01)
*C10J 3/74* (2006.01)
(Continued)

(52) U.S. Cl.
CPC ..... *F23D 14/78* (2013.01); *C10J 3/506* (2013.01); *C10J 3/74* (2013.01); *C10J 2200/152* (2013.01);
(Continued)

(58) Field of Classification Search
CPC ..... C10J 2300/1223; C10J 2200/152; C10J 3/76; C10J 2200/09; C10J 3/74;
(Continued)

(56) References Cited

U.S. PATENT DOCUMENTS 328,284 A * 10/1885 Brown ..... C21B 7/16 122/6.6
3,233,597 A * 2/1966 Svendsen ..... F23M 7/00 122/235.11

(Continued)

FOREIGN PATENT DOCUMENTS

AU 2011373507 A1 3/2014
WO 2009019271 A1 2/2009

OTHER PUBLICATIONS

International Search Report and Written Opinion received for PCT Patent Application No. PCT/EP2016/074152, dated Dec. 12, 2016, 8 pages.

*Primary Examiner* — Imran Akram
(74) *Attorney, Agent, or Firm* — Amy Carr-Trexler

(57) ABSTRACT

A gasification reactor comprises a pressure shell; a reaction zone partly bounded by a tubular membrane wall enclosed by the pressure shell; at least one burner having a burner head, said burner head protruding the membrane wall; at least one cooling device arranged in the membrane wall and enclosing the burner head of at least one burner, the at least one cooling device comprising several concentric rings of increasing diameter, forming a truncated cone shape having a largest diameter opening facing the reaction zone and a smallest diameter opening facing the burner head, each ring being a conduit having an inlet and an outlet for a cooling medium, the smallest diameter opening for the burner head being located between the pressure shell and the membrane
(Continued)

wall; the cooling device comprising at least one part-circular outer ring having an interruption.

16 Claims, 7 Drawing Sheets

(51) Int. Cl.
*C10J 3/50* (2006.01)
*F23B 90/06* (2011.01)
*F23G 5/027* (2006.01)

(52) U.S. Cl.
CPC ..... *C10J 2300/1223* (2013.01); *F23B 90/06* (2013.01); *F23D 2212/20* (2013.01); *F23D 2214/00* (2013.01); *F23D 2700/023* (2013.01); *F23G 5/027* (2013.01)

(58) Field of Classification Search
CPC .. C10J 3/845; F23D 14/78; F23D 1/00; F23D 2214/00; F23D 11/36; F23D 2213/00; B01J 2208/00504
See application file for complete search history.

(56) References Cited

U.S. PATENT DOCUMENTS

| | | | | |
|---|---|---|---|---|
| 3,712,602 | A * | 1/1973 | Brown | C21B 7/16 122/6.6 |
| 4,394,849 | A * | 7/1983 | Pratt | F22B 37/147 122/235.12 |
| 4,510,874 | A | 4/1985 | Hasenack | |
| 4,523,529 | A | 6/1985 | Poll | |
| 4,818,252 | A | 4/1989 | Kohnen et al. | |
| 4,887,962 | A | 12/1989 | Hasenack et al. | |
| 4,959,080 | A | 9/1990 | Sternling | |
| 5,101,773 | A * | 4/1992 | White | F22B 37/147 122/235.13 |
| 5,203,284 | A * | 4/1993 | Dietz | B04C 5/04 122/4 D |
| 8,628,595 | B2 | 1/2014 | Von Kossak-Glowczewski et al. | |
| 2008/0222955 | A1* | 9/2008 | Jancker | C10J 3/845 48/67 |
| 2009/0049747 | A1* | 2/2009 | Von Kossak-Glowczewski | C10J 3/485 48/77 |
| 2013/0233255 | A1* | 9/2013 | Chen | F22B 37/103 122/1 B |

* cited by examiner

COOLING DEVICE FOR A BURNER OF A GASIFICATION REACTOR

CROSS REFERENCE TO RELATED APPLICATIONS

This is a national stage application of International application No. PCT/EP2016/074152, filed 10 Oct. 2016, which claims benefit of priority of European application No. 15189436.7, filed 12 Oct. 2015.

The invention relates to a cooling device for a burner of a gasification reactor. The invention also relates to a gasification reactor provided with the cooling device.

The cooling device, also referred to as burner muffle, is applicable to cool and otherwise protect the reactor facing end of a burner for a gasification reactor.

Gasification is a process for the production of synthesis gas by partial combustion of a carbonaceous feed. The carbonaceous feed may, for instance, comprise pulverized coal, biomass, oil, crude oil residue, bio-oil, hydrocarbon gas or any other type of carbonaceous feed or any mixture thereof. The gasification reaction produces synthesis gas, which is a gas comprising, at least, carbon monoxide and hydrogen. Synthesis gas may be used, for instance, as a fuel gas or as a feedstock for chemical processes. The synthesis gas can be processed, for instance, to make predetermined types of hydrocarbon products, such as, but not limited to, methanol, synthetic natural gas, gasoline, diesel, wax, lubricant, etc.

U.S. Pat. No. 4,818,252 describes an arrangement for gasifying finely divided, particularly solid fuel under increased pressure with a multi-pipe wall having a plurality of pipes arranged to be supplied with a cooling medium, the multi-pipe wall limiting a gas-collecting chamber and also limiting a plurality of recesses which form combustion chambers. A burner extends into each recess. Each of the recesses has a plurality of parameters including a depth, a width and an angle of inclination of a peripheral wall, such that at least one of the parameters is changeable. For operation of the gasifying arrangement, the size of the recess may be changed in dependence upon the fuel, the speed of gasification, the temperature of the gasification, or the composition of gases as examples of operating parameters. This can be achieved in an advantageous manner by recess inserts which can change the depth of the recess. The multi-pipe wall structure may hold the recess wall releasably from the multi-pipe wall structure of the gas collecting chamber and may have an independent cooling system. For protecting of the burners, it is recommended to provide a slag-collecting protecting shield. This protecting shield can be formed advantageously from a tubular piece projecting from the cover plate and preferably coated with a layer of a fire resistant (refractory) material.

The recess of U.S. Pat. No. 4,818,252 is vulnerable to slag ingress, when the gasification reaction is conducted under conditions wherein a thick layer of viscous liquid slag forms on the inside of the multi-pipe wall. In such a situation the slag will flow in front of the burner head and disturb the combustion. The protecting shield is not adequate to cope with relatively thick layers of slag.

U.S. Pat. No. 8,628,595 discloses a gasification reactor comprising a pressure shell, a reaction zone partly bounded by a vertically oriented tubular membrane wall, and a horizontally directed burner having a burner head. The burner protrudes through the membrane wall via a cone-shaped burner muffle, comprising several vertically oriented, concentric and interconnected rings. Successive rings have an increasing diameter relative to preceding neighbouring rings so that the burner muffle has a muffle opening for the burner head at one end and a larger opening at its other flame discharge-end. The rings comprise a conduit having an inlet end for a cooling medium and an outlet for used cooling medium. The muffle opening for the burner head is located between the pressure shell and the membrane wall. At least one ring of the burner muffle protrudes into the reaction zone, to prevent slag from entering the burner muffle and from depositing on the surface of the muffle. The burner muffle of U.S. Pat. No. 8,628,595 enables to cool the surfaces of the burner muffle, resulting in a robust design which can operate at relatively high gasification pressures, exceeding, for instance, 30 bar.

The present invention aims to provide an improved burner muffle, having an increased lifespan.

The present invention provides a cooling device for a burner of a gasification reactor, the cooling device comprising:

several concentric rings of increasing diameter, forming a truncated cone shape having a largest diameter opening for facing the reaction zone of the gasification reactor and a smallest diameter opening for facing a burner head of the burner, each ring being a conduit having an inlet and an outlet for a cooling medium, the cooling device comprising at least one part-circular outer ring having an interruption.

In an embodiment, the interruption extends over a predetermined radial angle.

The cooling device may comprise two or more part-circular outer rings.

The cooling device may comprise one or more first outer rings extending over a first radial angle $\alpha$, being interrupted over a first angle $\beta$, and one or more subsequent outer rings extending over a second radial angle $\gamma$, the second radial angle exceeding the first radial angle, being interrupted over a second angle $\delta$. The first radial angle may be about 240°. The second radial angle may be about 260°.

According to another aspect, the invention provides a gasification reactor comprising:

a pressure shell;

a reaction zone partly bounded by a tubular membrane wall enclosed by the pressure shell;

at least one burner having a burner head, said burner head protruding the membrane wall;

at least one cooling device arranged in the membrane wall and enclosing the burner head of at least one burner, the at least one cooling device comprising several concentric rings of increasing diameter, forming a truncated cone shape having a largest diameter opening facing the reaction zone and a smallest diameter opening facing the burner head, each ring being a conduit having an inlet and an outlet for a cooling medium, the smallest diameter opening for the burner head being located between the pressure shell and the membrane wall; and the cooling device comprising at least one part-circular outer ring having an interruption.

In an embodiment, the interruption of the at least one outer ring faces downward, in the direction of gravity.

In another embodiment, at least one ring of the cooling device protrudes into the reaction zone.

By way of example, embodiments of the invention will be described in detail herein below, with reference to the drawings, wherein.

Figure 1:
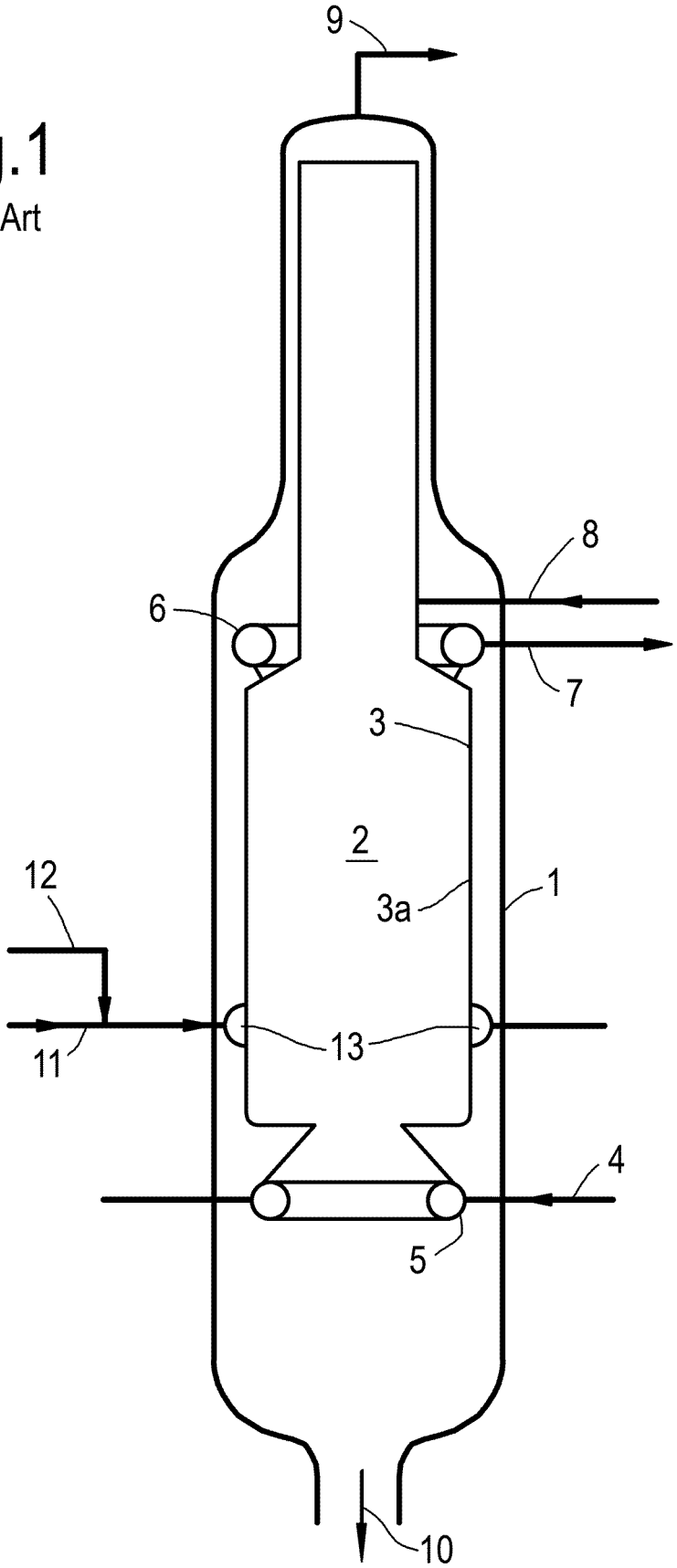
Fig.1 Prior Art
FIG. 1 shows a schematic cross section of an exemplary embodiment of a gasification reactor.

FIG. 1 shows an exemplary gasification reactor having a tubular pressure shell 1, a membrane wall 3 and a reaction zone 2. The reactor and the membrane wall are normally positioned vertically. Section 3*a* of the membrane wall 3 may have a tubular shape. The membrane wall 3 may be composed of conduits for guiding a cooling medium, such as water. The conduits generally extend in a vertical direction. Alternatively, spiraling conduits may be used.

Water may be supplied to the membrane wall via supply line 4 and a common distributor 5. The used cooling water, typically in the form of a mixture of water and steam, may be discharged from the reactor via common header 6 and discharge line 7. The reactor may comprise a quench gas supply 8 for cooling the produced syngas. A discharge line 9 may discharge the syngas, a mixture of hydrogen and carbon monoxide. Discharge line 10 may be provided to discharge slag.

The reactor is typically provided with one or more burners 13 for partial oxidation of a feedstock. Two diametrically opposed burners 13 are shown. The reactor may comprise, for example, two or more pairs of burners at the same elevation, or alternatively at different elevations. Suitable burners for a coal feed are, for example, described in U.S. Pat. Nos. 4,523,529 and 4,510,874. The invention however may relate to burners for any other type of hydrocarbon comprising feedstock as well. The feedstock may be provided to the burners via supply line 11. Oxygen may be provided via an oxygen supply line 12.

Figure 2:
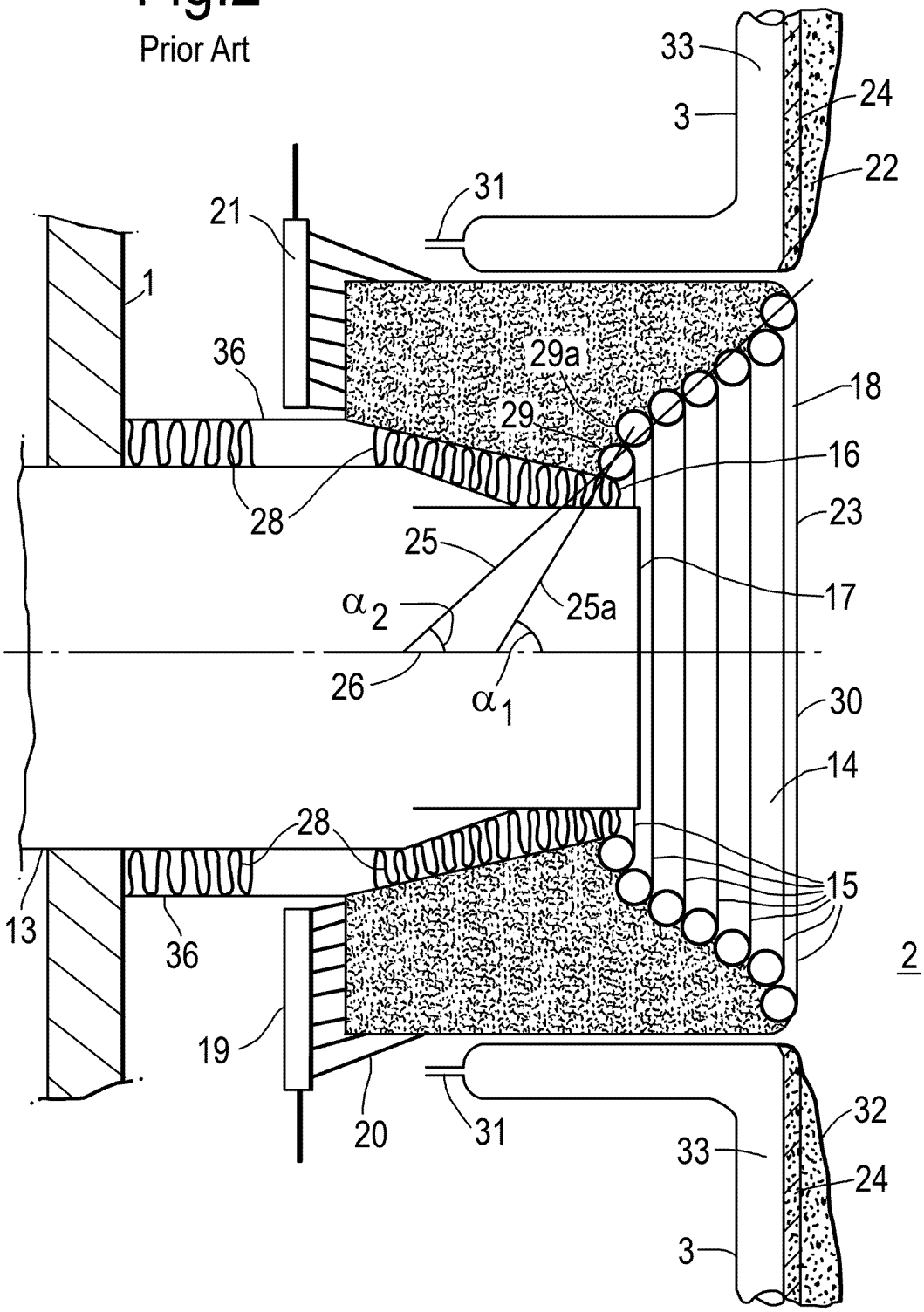
Fig.2 Prior Art
FIG. 2 shows a cross section of a burner muffle according to the prior art.

FIG. 2 shows a burner 13 protruding membrane wall 3. The burner end 17 facing the reactor 2 is provided with a cooling device 14, having a burner opening 16 for the burner head 17. The cooling device or burner muffle 14 encloses the burner head. The opening may be located between the pressure shell 1 and the membrane wall 3. In this example, the burner muffle 14 does not protrude into the reaction zone. Opening 18, opposite the burner opening 16, is flush with the membrane wall 3.

Figure 3:
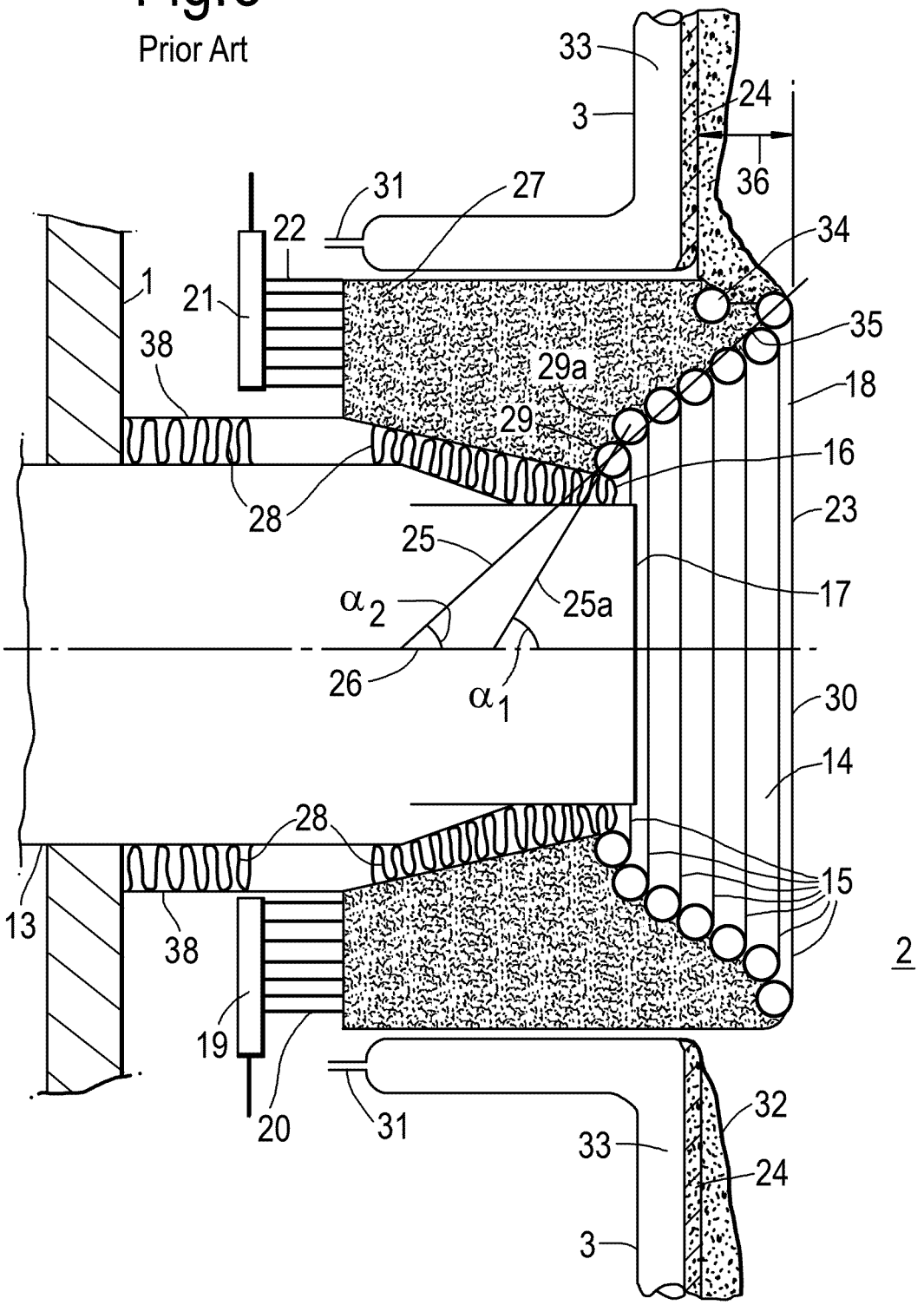
Fig.3 Prior Art
FIG. 3 shows a cross section of another burner muffle according to the prior art.

FIG. 3 illustrates another prior art example of a burner 13 and a burner muffle 14. Herein, the cooling device 14 protrudes into the reaction zone 2. The protrusion prevents slag 32 from entering the burner muffle 14. Preventing or limiting slag from depositing on the surface of the burner muffle 14 limits local heat fluxes. Due to the protruding burner muffle 14, the slag 32 will flow around the exterior of the outer ring 30 downwards, preventing the slag from entering the conical recess formed by the cooling device 14.

The cooling device or muffle 14 may protrude into the reaction zone 2 over a distance 36. A minimum may be predetermined for the distance 36, depending on the ash properties and ash content in the feedstock. The minimum for distance 36 may be about equal to the average outer diameter of the conduits that form the rings 15. In a practical embodiment, the distance 36 may be set between about two to four times the average outer diameter of the conduits forming the rings 15. The distance 36 is defined as the horizontal distance between the outer positioned ring 30 and the surface of the refractory 24 as shown.

FIG. 3 shows a burner muffle or cooling device 14 provided with a conduit 34 positioned at or near its upper end. The conduit 34 forms a slag gutter 35 along the upper part of the circumferential defined by opening 18 and outer ring 30. The conduit 34 has an inlet at one end for a cooling medium and an outlet for used cooling medium at its other end (not shown).

FIGS. 2 and 3 further show a burner muffle 14 comprising several vertically oriented, concentric rings 15. The rings are typically formed by conduits for cooling medium. The cooling medium can be supplied via lines 20, and discarded via lines 22.

Lines 20 may be fluidly connected to cooling medium distributor 19. Lines 22 may be connected to a common header 21 respectively. The header 21 typically discards of a mixture of water and steam. The cooling medium, typically comprising water, as supplied via lines 20 may be from the same source as the cooling water supplied to the conduit 33 of the membrane wall 3. It can be also from a different source, which may have a lower water temperature and/or a different pressure. The rings are preferably welded together.

Rings 15 have an increasing diameter relative to its neighbouring ring 15 resulting in that the burner muffle 14 has a muffle opening 16 for the burner head 17 at one end and a larger opening 18 at its other—flame discharge—end 23. The muffle opening 16 is horizontally spaced away from the larger opening 18. This results in the connected rings having a cone-shaped form.

The angle $\alpha 1$ between the horizon 26 and the direct line 25*a* between the inner positioned ring 29 at the muffle opening 16 for the burner head 17 and the next ring 29*a*, adjacent to the inner ring 29, is between 15 and 60°. Preferably the angle $\alpha 2$ between the horizon 26 and the direct line 25 between the inner positioned ring 29 at the muffle opening 16 for the burner head 17 and the outer positioned ring 30 at the opening 18 at the flame discharge end 23 is between 20 and 70°. The line 25 is drawn from the centre of ring 29 to the centre of ring 30 as shown in FIG. 2. The line 25*a* is also drawn from the centre to the centre of the ring as shown. Preferably $\alpha 1$ is greater than $\alpha 2$. The outer positioned ring 30 is the ring that forms the muffle opening 16 for the burner head 17.

The number of rings 15 may be between 6 and 10. The rings 15 may form a S-curve along line 25 as shown. Preferably a sealing 28 is present between the shaft of burner 13 and the burner sleeve 36. The sealing 28 can be extended to the burner head 17 as shown. Such a sealing 28 prevents gas and fly-ash and/or slag as present in the reaction zone from entering the burner sleeve 36 as present in the space between pressure shell 1 and membrane wall 3. By avoiding such a gas flow, local heat fluxes are further reduced. The sealing 28 may comprise a flexible sealing material which is able to accommodate local thermal expansion. Examples of suitable sealing materials are fibre-woven and or knitted wire mesh type sealing materials.

FIGS. 2 and 3 also show part of the membrane wall 3. The membrane wall 3 may typically comprise several vertical conduits 33 through which a cooling medium can flow. The cooling medium may typically comprise water. The conduits 33 can be provided with supply lines and discharge lines 31 as schematically shown. The conduits 33 may be coated with refractory 24.

In use, the refractory material 24 will be covered by a layer of slag 32, as for example described in U.S. Pat. No. 4,959,080. FIGS. 2 and 3 also show an optional refractory mass 27 enclosing the burner muffle 14. The refractory mass 27 prevents slag from entering the rear end of the muffle 14 and from reaching the burner head 17.

Figure 4:
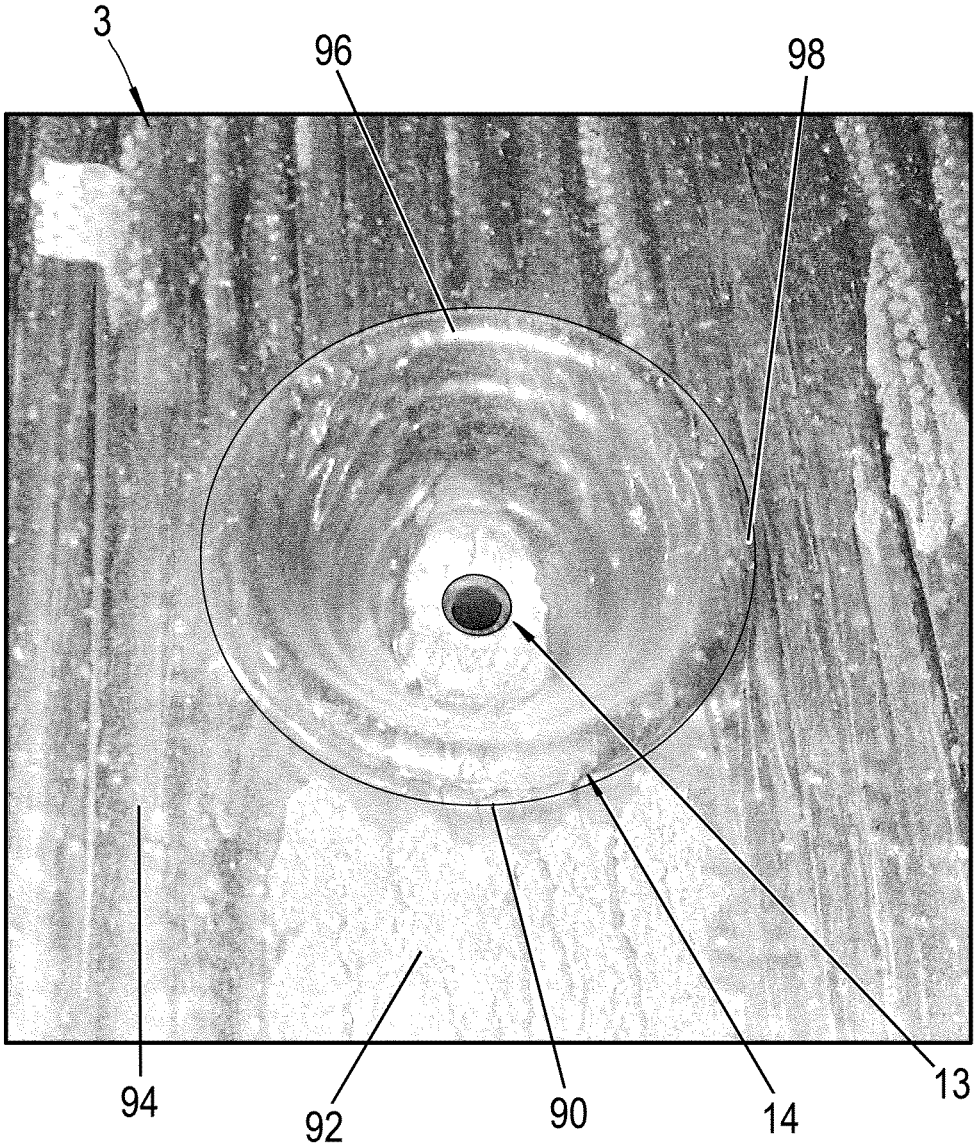
FIG. 4 shows a front view of a practical example of a burner muffle according to the prior art.

However, in practice, the burner muffles muffles as described above have shown corrosion after a relatively short time of operation, e.g. in the order of a few months. Corrosion was observed, for instance, on the outer rings of the burner muffle and/or at the lower part 90 of the outer rings 18 (FIG. 4). Thickness of the layer of slag below the burner muffles, indicated in FIG. 4 as reduced slag thickness area 92, was significantly less than the thickness of the slag layer 94 covering the inner wall of the gasifier in general. Slag coverage at the top 96 and both sides 98 of the burner muffles 14 was typically similar to the slag coverage of the inner gasifier wall. Only minimal slag coverage was found below the burner 13.

The slag layer 94 shields and protects the materials of the burner muffle and the membrane wall from the high temperature and corrosive environment in the gasifier. The protection provided by the reduced slag layer thickness area 92 is correspondingly limited. The corrosion will reduce the lifetime of the burner muffle tubes. Due to the reduced protection provided by the reduced thickness of the slag layer, the membrane wall and/or the burner muffle can be damaged during long time, continuous operation of the gasifier (FIG. 4).

Figure 5:
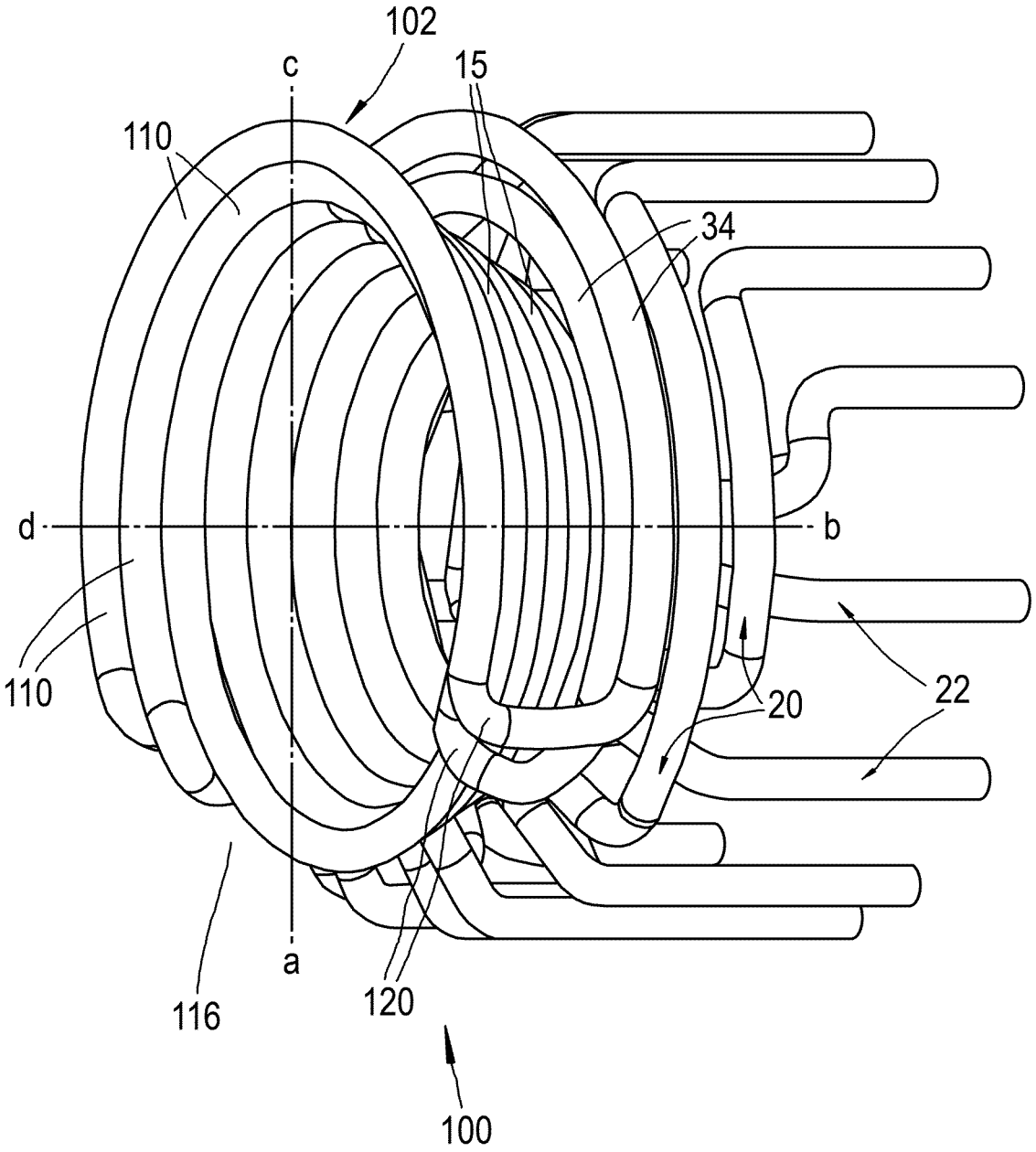
FIG. 5 shows a perspective view of an embodiment of a burner muffle according to the present invention.

FIG. 5 shows a burner muffle 100 for a gasification reactor according to the invention. The upper part 102 of the burner muffle is unchanged with respect to the embodiments as described above. The upper part 102 may extend into the gasification reactor for slag deflection.

Figure 6:
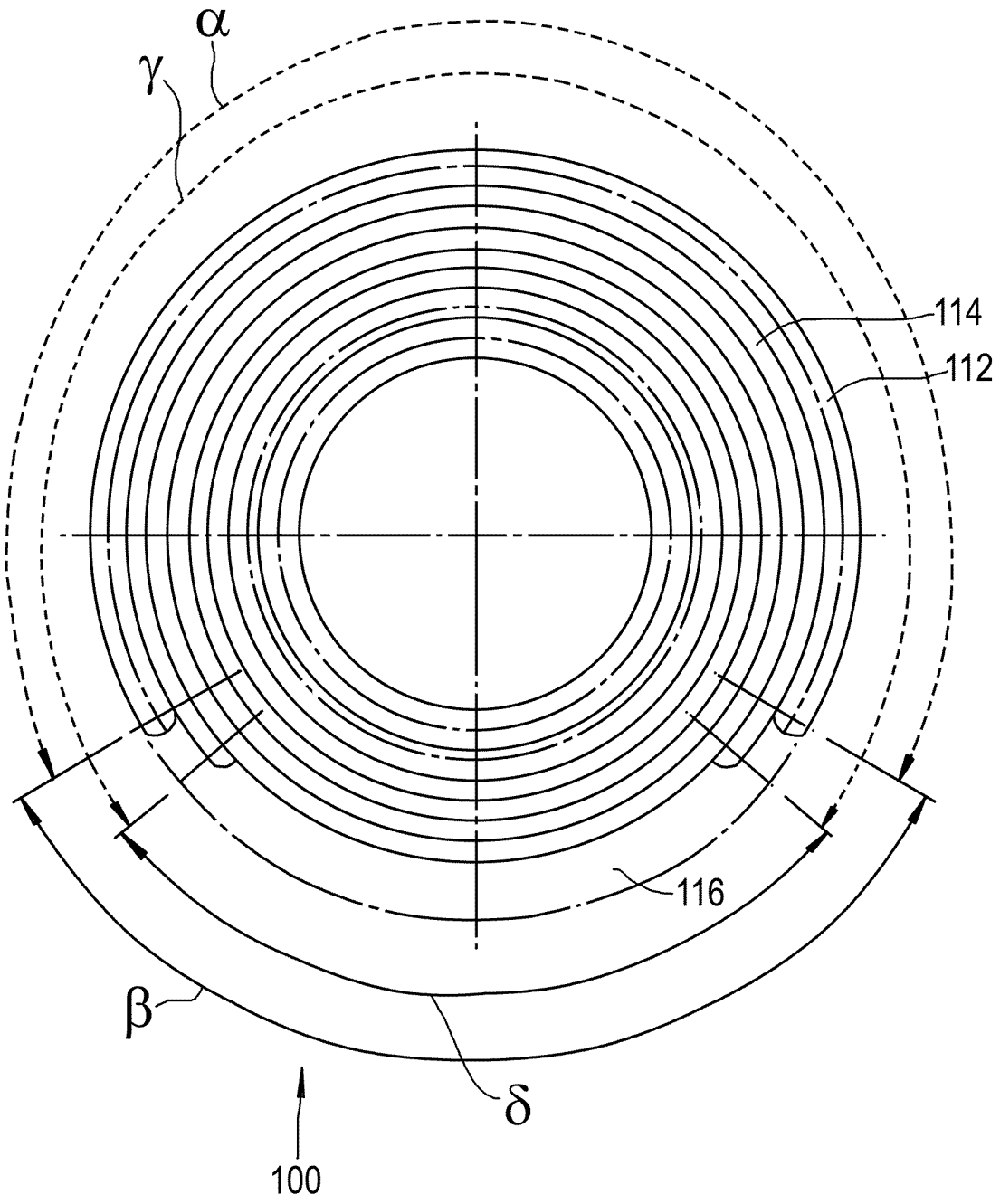
FIG. 6 shows a front view of an embodiment of a burner muffle according to the present invention.
Figure 7:
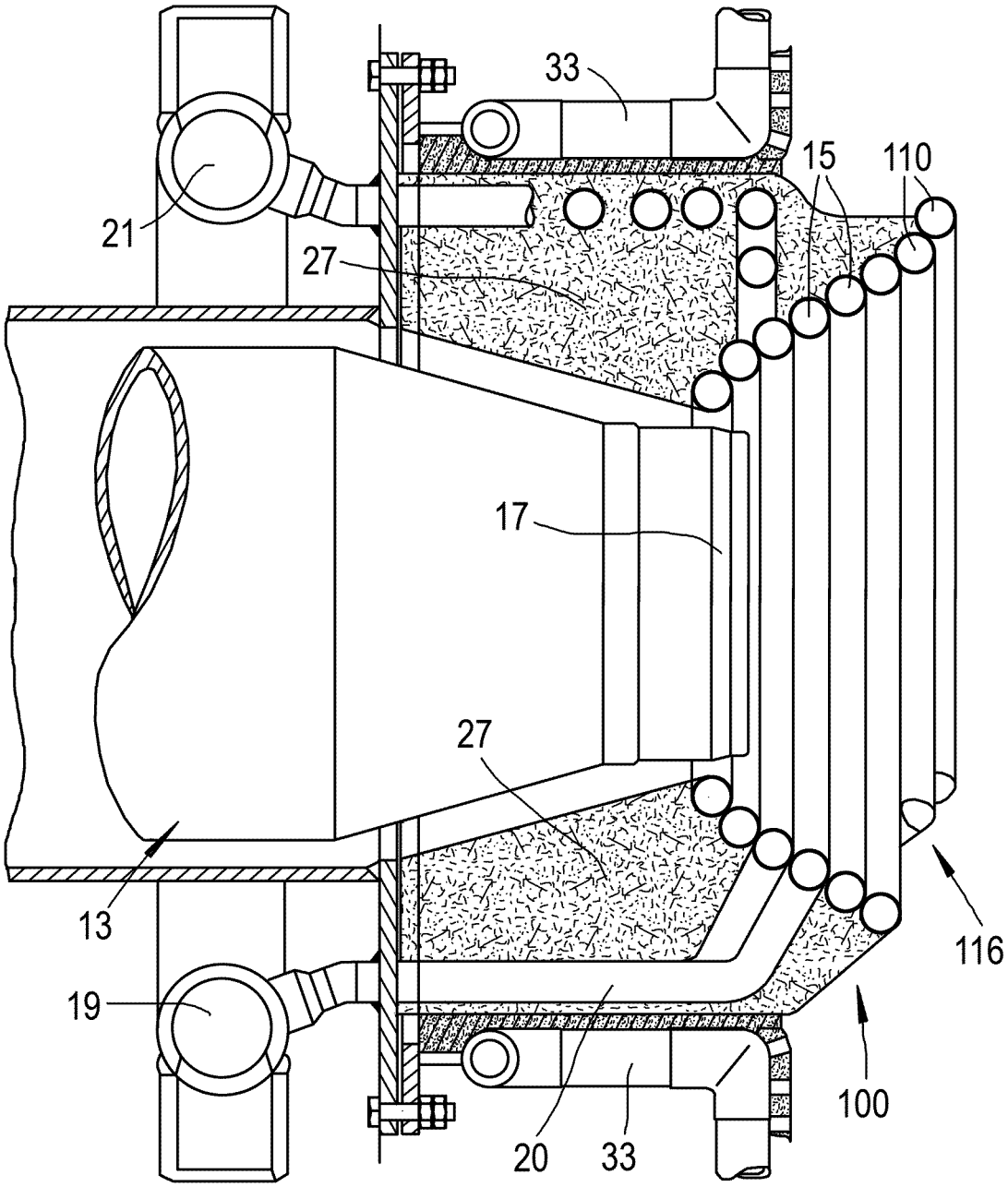
FIG. 7 shows a cross section of an embodiment of a burner muffle according to the present invention.

The burner muffle 100 has a modified lower part. At least one, for instance two or more, of the outer rings 110 of the burner muffle is interrupted over a predetermined radial angle. The interruption 116 faces downward, in the direction of gravity. The, for instance two, interrupted outer rings will form sub-rings, as illustrated in FIG. 6.

One or more, or all of rings 15 may have individual inlets and individual outlets for cooling medium. Alternatively, two or more of the rings 15 may be interconnected, forming a spiraling ring structure.

In an embodiment, one or more outer rings 112 may extend over a first radial angle $\alpha$, being interrupted over an angle $\beta$. One or more subsequent outer rings 114 may extend over a second radial angle $\gamma$, exceeding the first radial angle, being interrupted over an angle $\delta$. For instance, a first interrupted outer ring 112 may extend over about 240°, being interrupted over 120°. A subsequent interrupted outer ring 114 may extend over about 260°, being interrupted over 100°.

The one or more interrupted rings 110, 112, 114 may be replaceably connected to the rest of the burner muffle 100. Outer ring connections 120 may be breakable and replaceable. The connections 120 may be, for instance, welded, clamped, (crimp) fitted, bolted, or otherwise replaceably connected.

The interrupted outer rings 110 can be replaced separately, obviating the replacement of the entire burner muffle 100. This is beneficial, for instance, because: a) the repair time is reduced compared to the exchange of the entire burner muffle; and b) the repair costs are significantly reduced with respect to replacing the entire cooling device 100.

Using a conservative estimation, it is assumed that the entire outer ring, in use, will be covered with slag and has to be able to withstand a maximum specified heat flux of 1500 $KW/m^2$. The outer ring herein may include, at least, rings 110, and optionally also ring 34 indicated in FIG. 3. Tests have indicated that, in practice, the estimated maximum specified heat flux of 1500 $Kw/m^2$ can be exceeded.

A full circular ring, extending 360°, can withstand a max heat flux of 1800 $KW/m^2$ before departure from nucleate boiling (DNB) will occur. Departure from DNB will typically result in immediate damage to the tube of the cooling ring.

A part circular ring 110 can withstand an increased heat flux. A part circular ring 112, extending over for instance 240°, may withstand a maximum heat flux of 2100 $KW/m^2$ before departure from nucleate boiling will occur. Herein, rings may be made of the same material, for comparison.

Given operational challenges in practice, especially in early stages of the process, for instance during start up of a gasification process, higher design margins for DNB in burner muffle tubes are highly recommended.

In addition, the interrupted rings of the cooling device of the invention improves repair possibilities. High temperature corrosion, resulting from, for instance, H2S in the syngas, will typically start at the rings closest to the gasification reactor, which are the most exposed to the syngas.

In prior art cooling devices, the entire muffle 14 needs to be replaced if, for instance, the outer ring shows heavy wall thinning due to corrosion. Overlay welding or local repairs are possible, but repair quality is always a concern.

The accessibility for repair may depend on the protrusion 36 of the muffle. For instance: —A protrusion exceeding 80 mm may allow to exchange one outer ring in situ; —A protrusion exceeding 100 mm may allow to exchange two outer rings in situ.

Based on practical experience, the design of the gasification reactor may be modified. For instance, the size of the gasifier has been changed to a so called "intensified" design, wherein the diameter of the gasification reactor 2 is smaller. As a result, the slag load on the gasifier wall increased correspondingly.

The burner muffle according to the invention reduces corrosion on the outer rings. The muffle is provided with interrupted outer rings. Also, the outer rings have larger safety factors for departure from nucleate boiling (DNB). In the burner muffle of the invention, slag will not drop from the outer rings, but flow downward on the membrane wall below the burner muffle, covering the membrane wall in the area 92 below the burner muffle, and potentially also the lower section of the burner muffle, with an even layer of slag. The layer of slag provides additional protection from the corrosive environment in the gasifier. Thus, the cooling device of the invention prevents corrosion of the outer rings thereof, limiting corrosion. Also, the device improves the protective slag layer on the membrane wall. This increases the lifespan of the burner muffle and the membrane wall.

In a practical application, the temperature in the reactor chamber may typically be in the range of 1500 to 1700° C. The pressure in the reactor chamber may generally be in the range of 25-60 barg.

The wall thickness of the conduits of the burner muffle is preferably as small as possible to optimize heat transfer and to limit the wall temperature. The minimum wall thickness will be determined by the mechanical strength of the conduit material, as required locally. The diameter of the conduits 15 may be between about 2 and 5 cm. The rings may be made from a low alloy steel with a Cr content up to 5 wt % or a high alloy steel with Cr content above 15 wt %.

The present invention is not limited to the above described embodiments thereof, wherein various modifications are conceivable within the scope of the appended claims.

That which is claimed is:

1. A cooling device for a burner of a gasification reactor, the cooling device comprising:

several concentric rings of increasing diameter, forming a truncated cone shape having a largest diameter opening facing a reaction zone of the gasification reactor and a smallest diameter opening facing a burner head of a burner, each ring being a conduit having an inlet and an outlet for a cooling medium, at least one separately replaceable part-circular outer ring positioned adjacent the concentric rings that form the truncated cone shape at an outer side of the truncated cone shape adjacent the largest diameter opening, each of the at least one part-circular outer ring having an interruption, the interruption of the at least one part-circular outer ring facing downward in a direction of gravity to define the interruption along an interruption angle, the interruption angle being a predetermined radial angle defining an extent to which a bottom gap extends.

2. The cooling device of claim 1, wherein the at least one part-circular outer ring comprises two or more part-circular outer rings.

3. The cooling device of claim 2, wherein the at least one part-circular outer ring comprises:

one or more first part-circular outer rings extending over a first radial angle $\alpha$, wherein the interruption angle of each first part-circular outer ring is a first interruption angle $\beta$, and one or more subsequent second part-circular outer rings extending over a second radial angle $\gamma$, the second radial angle exceeding the first radial angle, wherein the interruption angle of each second part-circular outer ring is a second interruption angle $\delta$ that is smaller than the first interruption angle.

4. The cooling device of claim 3, wherein the first radial angle is 240°.

5. The cooling device of claim 3, wherein the second radial angle is 260°.

6. The cooling device according to claim 1, wherein the concentric rings of increasing diameter include between 6 and 10 rings.

7. The cooling device according to claim 1, wherein the concentric rings are made from a steel with a Cr content of up to 5 wt % or a steel with Cr content above 15 wt %.

8. The cooling device of claim 1, wherein the cooling device is configured as a burner muffle so slag will flow downward from the at least one part-circular outer ring and cover a membrane wall below the burner muffle.

9. A gasification reactor comprising:

a pressure shell;

a tubular membrane wall enclosed by the pressure shell, the tubular membrane wall partly bounding a reaction zone;

at least one burner having a burner head, said burner head protruding the membrane wall;

at least one cooling device arranged in the membrane wall and enclosing the burner head of the at least one burner, the at least one cooling device comprising:

several concentric rings of increasing diameter, forming a truncated cone shape having a largest diameter opening facing the reaction zone and a smallest diameter opening facing the burner head, each ring being a conduit having an inlet and an outlet for a cooling medium, the smallest diameter opening for the burner head being located between the pressure shell and the membrane wall, and at least one separately replaceable part-circular outer ring positioned adjacent the concentric rings that form the truncated cone shape at an outer side of the truncated cone shape adjacent the largest diameter opening of the truncated cone shape, each of the at least one part-circular outer ring having an interruption, the interruption of the at least one part-circular outer ring facing downward in a direction of gravity to define the interruption along an interruption angle, the interruption angle being a predetermined radial angle defining an extent to which a bottom gap extends.

10. The gasification reactor of claim 9, wherein the at least one part-circular outer ring comprises:

one or more first part-circular outer rings extending over a first radial angle $\alpha$, wherein the interruption angle of each first part-circular outer ring is a first interruption angle $\beta$, and one or more subsequent second part-circular outer rings extending over a second radial angle $\gamma$, the second radial angle exceeding the first radial angle, wherein the interruption angle of each second part-circular outer ring is a second interruption angle $\delta$ that is smaller than the first interruption angle.

11. The gasification reactor of claim 9, wherein at least one of the concentric rings of the cooling device protrudes into the reaction zone.

12. The gasification reactor of claim 10, wherein the first radial angle is 240°.

13. The gasification reactor of claim 12, wherein the second radial angle is 260°.

14. The gasification reactor of claim 10, wherein the second radial angle is 260°.

15. The gasification reactor of claim 9, wherein the concentric rings of increasing diameter include between 6 and 10 rings.

16. The gasification reactor of claim 9, wherein the cooling device is configured as a burner muffle so slag will flow downward from the at least one part-circular outer ring and cover the membrane wall below the burner muffle.

* * * * *